United States Patent [19]

Kogan

[11] Patent Number: 4,736,153

[45] Date of Patent: Apr. 5, 1988

[54] VOLTAGE SUSTAINER FOR ABOVE $V_{CC}$ LEVEL SIGNALS

[75] Inventor: Grigory Kogan, Portland, Oreg.

[73] Assignee: National Semiconductor Corporation, Santa Clara, Calif.

[21] Appl. No.: 82,784

[22] Filed: Aug. 6, 1987

[51] Int. Cl.[4] ..... G05F 3/20

[52] U.S. Cl. ..... 323/313; 323/349; 307/297; 307/304

[58] Field of Search ..... 323/313, 314, 315, 316, 323/317, 349, 350, 351; 307/296 R, 297, 304; 320/1

[56] References Cited

U.S. PATENT DOCUMENTS

| | | | |
|---|---|---|---|
| 4,032,838 | 6/1977 | Minami et al. | 323/349 |
| 4,307,333 | 12/1981 | Hargrove | 323/313 |
| 4,375,595 | 3/1983 | Ulmer et al. | 323/314 X |
| 4,628,214 | 12/1986 | Leuschner | 307/304 |
| 4,649,289 | 3/1987 | Nakano | 307/304 |
| 4,649,291 | 3/1987 | Konishi | 323/313 |

*Primary Examiner*—Peter S. Wong

*Attorney, Agent, or Firm*—Limbach, Limbach & Sutton

[57] ABSTRACT

This present invention provides a voltage sustainer which eliminates the DC current problems of conventional voltage sustainers. The embodiment of the voltage sustainer of the present invention comprises a first field effect transistor (FET) having its drain connected to a supply voltage and its drain connected to a second FET; a second FET having its drain connected to the source of the first FET, its source connected to an output node and its gate connected to the source of a third FET; a third FET having its source connected to the gate of the second FET and its drain connected to the output node; a first MOS capacitor having one side connected to receive an input signal and its other side connected to the interconnection between the source of the first FET and the drain of the second FET; and a second capacitor having one side connected to receive the input signal and its other side connected to the source of the third FET.

1 Claim, 1 Drawing Sheet

VOLTAGE SUSTAINER FOR ABOVE $V_{CC}$ LEVEL SIGNALS

BACKGROUND OF THE INVENTION

1. Field of the Invention

The present invention relates to integrated circuits and, in particular, to an improved integrated voltage sustainer circuit.

2. Discussion of the Prior Art

As shown in FIG. 1, a conventional voltage sustainer includes two field effect transistors (FETs) 10 and 12 which are sequentially connected, in diode configuration, between a supply voltage $V_{CC}$ and an output node A. An MOS capacitor 14 has one of its sides connected to receive an input signal $\phi s$. The other side of capacitor 14 is connected to the interconnection between the source of transistor 10 and the drain of transistor 12. The input signal $\phi s$ toggles between OV and $V_{CC}$. When the input signal $\phi s$ goes low, node B in FIG. 1 is precharged to $V_{CC}$-VT through transistor 10, where $V_T$ is the threshold voltage of each of the two transistors 10 and 12. When input $\phi s$ goes high, node B is pumped by capacitor 14 to $2V_{CC}$-$V_T$. This voltage travels through transistor 12 and sustains node A at $2V_{CC}$-$2V_T$.

The disadvantage of the conventional voltage sustainer configuration illustrated in FIG. 1 is that if node A goes low, i.e. to ground, than DC current is initiated from the supply $V_{CC}$ through both transistor 10 and transistor 12 to ground.

SUMMARY OF THE INVENTION

This present invention provides a voltage sustainer which eliminates the DC current problems associated with conventional voltage sustainers. A preferred embodiment of the voltage sustainer of the present invention comprises a first field effect transistor (FET) having its drain connected to a supply voltage and its source connected to a second FET; a second FET having its drain connected to the source of the first FET, its source connected to an output node and its gate connected to the source of a third FET; a third FET having its source connected to the gate of the second FET and its drain connected to the output node; a first MOS capacitor having one side connected to receive an input signal and its other side connected to the interconnection between the source of the first FET and the drain of the second FET; and a second MOS capacitor having one side connected to receive the input signal and its other side connected to the source of the third FET.

DETAILED DESCRIPTION OF THE INVENTION

Figure 2:
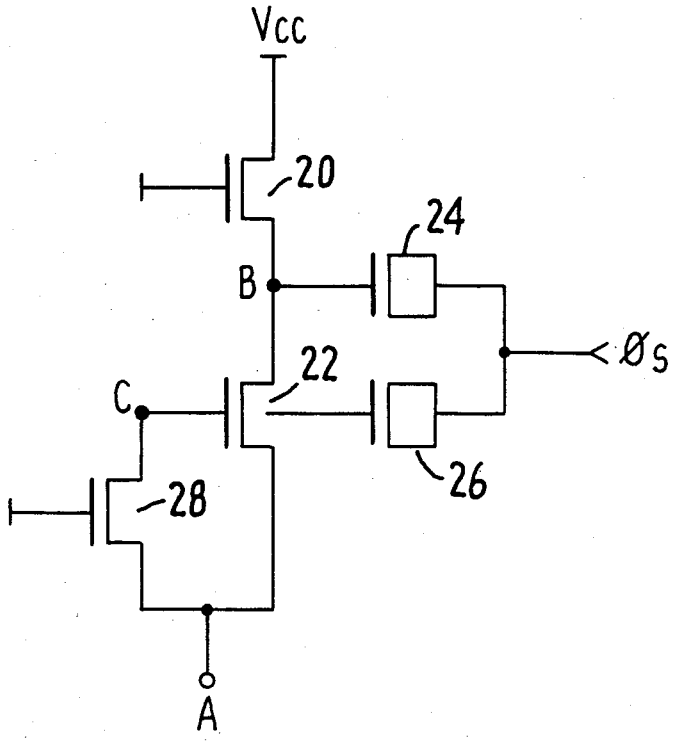
FIG. 2 is a schematic diagram illustrating a preferred embodiment of a voltage sustainer circuit in accordance with the present invention.

FIG. 2 illustrates a preferred embodiment of a voltage sustainer circuit in accordance with the present invention.

As shown in FIG. 2, two field effect transistors (FETs) 20 and 22 are sequentially connected between a supply voltage $V_{CC}$ and an output Node A. An input signal $\phi s$ is commonly provided both to the input side of MOS capacitor 24 and to the input side of MOS capacitor 26. The opposite sides of both capacitor 24 and of capacitor 26 are connected to node B and node C, respectively. Node B is the common connection between the source of transistor 20 and the drain of transistor 22. Node C is connected to the gate of transistor 22. A third FET 28 has its source connected to node C and its drain connected to the output node A.

Figure 1:
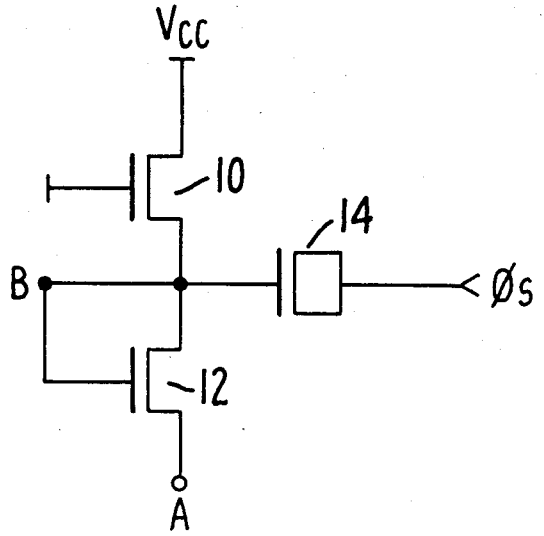
(PRIOR ART) FIG. 1.
FIG. 1 is a simple schematic diagram illustrating a conventional voltage sustainer circuit.

Thus, to overcome the DC current problem described above with respect to the prior art, and in accordance with the present invention, capacitor 26 and transistor 28 have been added to the conventional voltage sustainer configuration shown in FIG. 1.

In the circuit shown in FIG. 2, if node A goes to ground, then node C is discharged to ground through transistor 28. Thus, DC current flow is prevented. When node A goes high to above the supply level $V_{CC}$, then node C is precharged to $V_{CC}$-$V_T$ through transistor 28. In this case, the input signal $\phi s$ will pump both nodes B and C, via capacitors 24 and 26, respectively, to $2V_{CC}$-$V_T$ which travels through transistor 22 and sustains node A at the $2V_{CC}$-$2V_T$ level.

Thus, the voltage sustainer of the present invention provides the same capability to sustain node A at the $2V_{CC}$-$2V_T$ level as does the conventional sustainer shown in FIG. 1, but eliminates the DC current problem.

It should be understood that various alternatives to the embodiment of the invention described herein may be employed in practicing the invention. It is intended that the following claims define the scope of the invention and that structure within the scope of these claims and their equivalents be covered thereby.

What is claimed is:

1. A circuit for sustaining a preselected voltage level, the circuit comprising:

(a) a first field effect transistor (FET) having its drain connected to a supply voltage and its source connected to a second FET;

(b) said second FET having its drain connected to the source of the first FET, its source connected to an output node and its gate connected to the source of a third FET;

(c) said third FET having its source connected to the gate of the second FET and its drain connected to the output node;

(d) a first capacitor having one side connected to receive an input signal and its second side connected to the interconnection between the source of the first FET and the drain of the second FET; and (e) a second capacitor having one side connected to receive the input signal and its other side connected to the source of the third FET.

* * * * *